US008127704B2

(12) United States Patent
Vosburgh et al.

(10) Patent No.: US 8,127,704 B2
(45) Date of Patent: Mar. 6, 2012

(54) SUBMERSIBLE VEHICLES AND METHODS FOR TRANSITING THE SAME IN A BODY OF LIQUID

(75) Inventors: Frederick Vosburgh, Durham, NC (US); Ryan Moody, Durham, NC (US)

(73) Assignee: iRobot Corporation, Bedford, MA (US)

( * ) Notice: Subject to any disclaimer, the term of this patent is extended or adjusted under 35 U.S.C. 154(b) by 223 days.

(21) Appl. No.: 12/408,177

(22) Filed: Mar. 20, 2009

(65) Prior Publication Data

US 2009/0241826 A1 Oct. 1, 2009

Related U.S. Application Data

(60) Provisional application No. 61/039,658, filed on Mar. 26, 2008.

(51) Int. Cl.
*B63G 8/14* (2006.01)

(52) U.S. Cl. ..... 114/245

(58) Field of Classification Search ..... 114/245
See application file for complete search history.

(56) References Cited

U.S. PATENT DOCUMENTS 1,710,670 A * 4/1929 Bonney ..... 244/47
2,603,435 A * 7/1952 Metzler ..... 244/38
3,161,373 A * 12/1964 Vogt ..... 244/2
3,183,871 A * 5/1965 Reder ..... 114/281
5,078,338 A * 1/1992 O'Neill et al. ..... 244/47
6,179,683 B1 1/2001 Pell et al.
6,250,585 B1 6/2001 Pell
6,378,801 B1 4/2002 Pell et al.
6,598,554 B1 * 7/2003 Lasky et al. ..... 114/245
6,974,356 B2 12/2005 Hobson et al.
7,495,999 B2 2/2009 Kemp et al.

OTHER PUBLICATIONS

"Underwater glider," *Wikipedia*. 2011. Wikimedia Foundation, Inc., Sep. 1, 2011 http://en.wikipedia.org/w/index.php?title=Underwater_glider&printable=yes (3 pages).
"Perpetual Autonomus Survey Submersible," http://ideaintegrator.com/boats/pass/pass.htm, Tony Bigras. Retrieved Jul. 3, 2009 (2 pages).
"Rutgers undersea glider makes trans-Atlantic crossing," Kirk Moore—Abstract only, *Daily Record*, Dec. 6, 2009, http://www.dailyrecord.com/article/20091206/NEWS02/91204128/1123/Rutgers-undersea-glider-makes-trans-Atlantic-crossing (1 page).
"Robot glider harvests ocean heat," *BBC News*, Last updated Feb. 8, 2008, http://news.bbc.co.uk/2/hi/technology/7234544.stm (3 pages).
"NOC Glider Pages," *National Oceanography Centre*, UK Glider Home Page, Last updated Oct. 25, 2010, http://www.noc.soton.ac.uk/omf/projects/glider (1page).
"The Slocum Mission," Henry Stommel. *Oceanography*, Apr. 1989, (pp. 22-25).
"Underwater Gliders for Ocean Research," Rudnick et al., *Marine Technology Society Journal*, Spring 2004 vol. 38, No. 1 (pp. 48-59), Jun. 2004.

(Continued)

*Primary Examiner* — Stephen Avila
(74) *Attorney, Agent, or Firm* — Myers Bigel Sibley & Sajovec, PA

(57) ABSTRACT

A submersible vehicle for use in a body of liquid includes a vehicle body, a pair of fins coupled to the vehicle body on opposed sides thereof, and a dihedral angle control system. The dihedral angle control is system operative to vary a fin dihedral angle of each of the fins.

29 Claims, 11 Drawing Sheets

OTHER PUBLICATIONS

"Perpetual Autonomus Survey Submersible," http://ideainteqratorcom/boats/pass/pass.htm, Tony Bigras. Retrieved Mar. 7, 2009 (2 pages).

"Liberdade XRay Advanced Underwater Glider," Sep. 2001, http://www.onr.navy.mil/media/extra/fact_sheets/advanced_underwater_glider.pdf, (1 page).

"Experts in underwater GPS applications" http://www.underwater-gps.com/uk/product-detail.php?pr_id=8, (1 page), Sep. 2011.

"Underwater Glider Spray" http://spray.ucsd.edu/pub/rel/index.php, *Scripps Institution of Oceanography* (10 pages), Sep. 2011.

"Seaglider" *Applied Physics Laboratory—University of Washington*, http://www.apl.washington.edu/projects/seaglider/summarv.html (1 page), Sep. 2011.

"Slocum Glider," *Teledyne Webb Research*, http://www.webbresearch.com/slocumglider.aspx, (1 page), Sep. 2011.

"USM Underwater Glider configuration," *AUVAC—AUV System Spec Sheet*, http://auvac.org/configurations/view/89 (1 page), Sep. 2011.

* cited by examiner

SUBMERSIBLE VEHICLES AND METHODS FOR TRANSITING THE SAME IN A BODY OF LIQUID

RELATED APPLICATION(S)

This application claims the benefit of and priority from U.S. Provisional Patent Application Ser. No. 61/039,658, filed Mar. 26, 2008, the disclosure of which is incorporated herein by reference in its entirety.

FIELD OF THE INVENTION

The present invention relates to submersible vehicles and methods for transiting the same.

BACKGROUND OF THE INVENTION

Monitoring of the oceans and other bodies of water for purposes of scientific research, national defense, or commercial development is becoming increasingly automated to reduce costs. For example, unmanned undersea vehicles (UUV) have emerged as key tools in the offshore engineering industry. And considerable investment is being made by nations around the world to develop UUVs for national or homeland defense. With the increasing requirement for persistent intelligence, surveillance and reconnaissance (ISR) operations in areas where access is denied or where ISR is otherwise desirably clandestine, UUVs will be increasingly put to use. Use of UUVs to service devices historically tended by submarines, deep submersible vehicles and divers will substantially reduce cost and risk to the operators. So, it can be seen, persistent ISR and other activities in problematic areas drive the need for means of sensing and communicating that do not require human intervention or costly engineering systems.

Aquatic gliders are UUVs that are used for persistent ocean sensing. An aquatic glider may glide up and down through the water column for months at a time, driven by small changes in buoyancy provided by a buoyancy engine. Gliders used by the U.S. Navy include those offered by Webb Research in Falmouth, Mass., by the University of Washington in Seattle, Wash. and by Bluefin Robotics in Cambridge, Mass. These gliders have a fixed wing or wings that can convert a portion of buoyancy driven vertical movement into horizontal movement as means of providing transit without propellers.

Such a glider can transit great distances because the buoyancy engine uses only small amounts of power, intermittently at the end of each tip glide or down glide portion of its saw-tooth glide cycle path through the water. This intermittent use of energy conserves battery power and extends mission duration. Mission duration may come, however, at the expense of speed and maneuverability. Long-endurance gliders typically make only a fraction of a knot through the water and maneuver poorly, limiting their ability to penetrate shallower or more constrained areas of operation.

SUMMARY OF THE INVENTION

According to embodiments of the present invention, a submersible vehicle for use in a body of liquid includes a vehicle body, a pair of fins coupled to the vehicle body on opposed sides thereof, and a dihedral angle control system. The dihedral angle control is system operative to vary a fin dihedral angle of each of the fins.

In some embodiments, the submersible vehicle is an aquatic glider. The glider may include a buoyancy control system operable to selectively generate vertical force on the submersible vehicle by varying a buoyancy of the submersible vehicle, and the submersible vehicle is configured to generate a glide thrust responsive to changes in elevation of the submersible vehicle. According to some embodiments, the fin dihedral angle of each of the fins is upward when the submersible vehicle is descending and downward when the submersible vehicle is ascending.

In some embodiments, the submersible vehicle is a towed vehicle.

In some embodiments, the submersible vehicle includes an active thrust system operative to propel the submersible vehicle through the body of liquid.

According to some embodiments, each fin is joined to the body at a respective fin root and pivots about a pivot axis at the fin root to vary the fin dihedral angle of the fin. The submersible vehicle may include a pair of opposed stops associated with each fin and configured to limit the range of fin dihedral angles assumable by the fin.

According to some embodiments, the dihedral angle control system is operative to passively vary the fin dihedral angle of each of the fins.

In some embodiments, the dihedral angle control system includes at least one biasing member to change and/or maintain a dihedral angle of at least one of the fins.

The dihedral angle control system may include at least one magnet or magnetic actuator to induce each of the fins into at least one selected fin dihedral angle.

In some embodiments, the dihedral angle control system is operative to actively vary the fin dihedral angle of each of the fins. According to some embodiments, the dihedral angle control system includes: at least one magnetic actuator to induce each of the fins into at least one selected fin dihedral angle; and a magnet force controller to control an attraction force of the at least one magnetic actuator. According to some embodiments, the dihedral angle control system includes: at least one force actuator operable to forcibly vary the fin dihedral angles of the fins; and a force actuator controller to control actuation of the force actuator.

In some embodiments, the fins pivot independently of one another to position the fins at different respective fin dihedral angles from one another.

According to method embodiments of the present invention, a method of providing transit of a submersible vehicle through a body of liquid, the submersible vehicle including a vehicle body and a pair of fins coupled to the vehicle body on opposed sides thereof, includes varying a fin dihedral angle of each of the fins using a dihedral angle control system.

According to some embodiments, the submersible vehicle is a glider including a buoyancy control system, the method including using the buoyancy control system, selectively generating vertical force on the submersible vehicle by varying a buoyancy of the submersible vehicle and thereby changing the elevation of the submersible vehicle in the water, responsive to which the submersible vehicle generates a glide thrust on the submersible vehicle. In some embodiments, the method includes: positioning each fin to have an upward fin dihedral angle when the submersible vehicle is descending; and positioning each fin to have a downward fin dihedral angle when the submersible vehicle is ascending.

In some embodiments, varying the fin dihedral angle of each of the fins includes actively varying the fin dihedral angle of each of the fins using the dihedral angle control system. According to some embodiments, the dihedral angle control system includes: at least one magnetic actuator to induce each of the fins into at least one selected fin dihedral angle; and a magnet force controller; and the method includes controlling an attraction force of the at least one magnetic actuator using the magnet force controller. According to some embodiments, the dihedral angle control system includes: at least one force actuator operable to forcibly vary the fin dihedral angles of the fins; and a force actuator controller; and the method includes controlling actuation of the force actuator using the force actuator controller.

According to some embodiments, varying the fin dihedral angle of each of the fins includes pivoting the fins independently of one another to position the fins at different respective fin dihedral angles from one another. The method may include raising one of the fins to an upward fin dihedral angle and lowering the other fin to a downward fin dihedral angle to cause or assist turning of the submersible vehicle.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
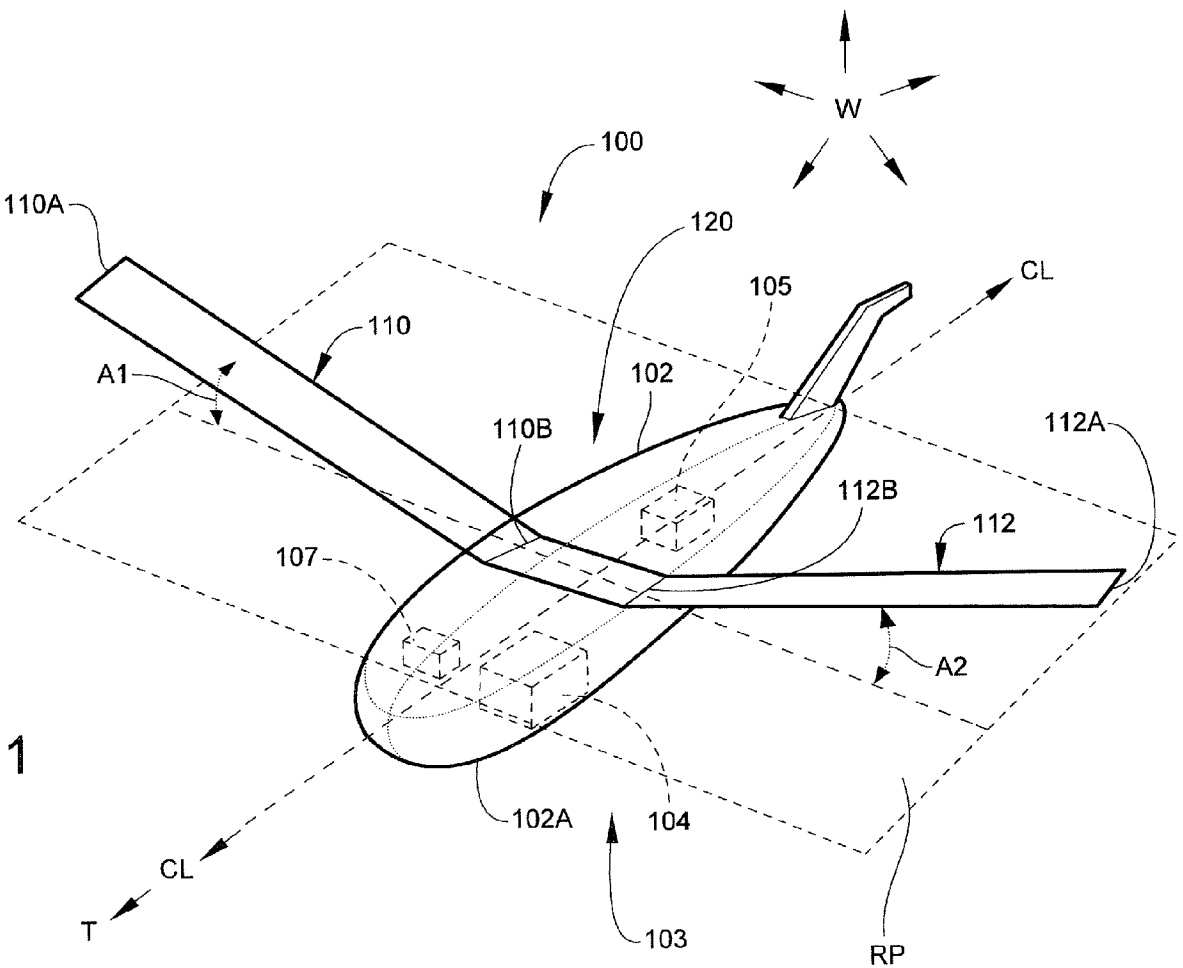
FIG. 1 is a front perspective view of a submersible vehicle according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the electronics device in use or operation in addition to the orientation depicted in the figures. For example, if the electronics device in the figures is turned over, elements described as "under" or "beneath" other elements or features would then be oriented "over" the other elements or features. Thus, the exemplary term "under" can encompass both an orientation of over and under. The electronics device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. Well-known functions or constructions may not be described in detail for brevity and/or clarity.

As used herein, "submersible" means an object that is submersible in an intended liquid, such as water, and constructed such that electronic and other components thereof sensitive to the liquid are protected from contact with the surrounding liquid.

As used herein, "fin dihedral angle" refers to an angle defined by a fin of a vehicle including a pair of opposed fins each joined to a body of the vehicle at a fin root, each fin having a fin tip opposite its fin root and defining a fin axis extending from its fin root to its fin tip. The dihedral angle of the fin is the angle defined between its fin axis and a reference plane, wherein the reference plane extends through the fin root of each fin and is parallel to a direction of travel of the vehicle body.

When the fin tip is located above the reference plane, the fin dihedral angle is referred to as "upward." When the fin tip is located below the reference plane, the fin dihedral angle is referred to as "downward."

The fin dihedral angle can also be characterized with respect to the direction of force due to net buoyancy of the vehicle. When the fin tip is located away from the reference plane on a side of the reference plane opposite the direction of net buoyancy of the vehicle, the fin dihedral angle is referred to as "positive." When the fin tip is located away from the reference plane on the same side of the reference plane as the direction of net buoyancy of the vehicle, the fin dihedral angle is referred to as "negative." Thus, when the fin dihedral angle is upward and the net buoyancy is downward (i.e., the vehicle is sinking), the fin dihedral angle is positive; when the fin dihedral angle is upward and the net buoyancy is upward (i.e., the vehicle is rising), the fin dihedral angle is negative; when the fin dihedral angle is downward and the net buoyancy is upward (i.e., vehicle rising), the fin dihedral angle is positive; and, when the fin dihedral angle is downward and the net buoyancy is downward (i.e., vehicle sinking), the fin dihedral angle is negative.

A fundamental impediment to conventional underwater glider performance is the use of fins having zero dihedral angle. It is well known that an upward, positive dihedral angle can enhance performance in heavier than air (negatively buoyant) aircraft. Aquatic gliders, however, glide both up and down according to their buoyancy. During up gliding, a fixed upward dihedral angle would act as an anhedral with adverse consequences. Current generation aquatic gliders have fins fixed with a zero degree (i.e., neutral) dihedral angle, sacrificing the enhancement of a non-zero dihedral angle to avoid adverse anhedral angle affects.

In accordance with embodiments of the present invention, a finned submersible vehicle (e.g., an aquatic vehicle) is provided having provision for beneficially varying the dihedral angles of its fins in order to overcome the above-described problems of conventional submersible vehicles. According to methods of the present invention, the dihedral angles of the fins are selectively varied to improve performance during the up and/or down portions of a glide cycle, which may be accomplished without substantially compromising mission duration. According to some embodiments, the fin dihedral angles are upward when the vehicle is descending and downward when the vehicle is ascending. In this manner, the fin dihedral angles provided are positive during both descent and ascent.

With reference to FIGS. 1-5, a submersible vehicle (e.g., a water submersible vehicle) 100 according to embodiments of the present invention is shown therein in a body of water W (e.g., an ocean, river or lake). According to some embodiments, the vehicle 100 is an unmanned underwater vehicle (UUV) or autonomous underwater vehicle (AUV). According to some embodiments, the vehicle 100 is an underwater glider. The vehicle 100 can be used for sensing, payload carrying or deploying, object servicing, and communicating in aquatic environments, for example. The vehicle 100 includes a vehicle body 102, a pair of opposed articulable fins 110, 112, a thrust system 103, a vehicle controller 107, and a dihedral angle control system 120. The vehicle 100 may include further components, systems or subcomponents such as a payload 105, a recharging system, and/or a power supply (e.g., a battery).

The vehicle controller 107 controls the operation and interoperation of the various modules and systems. The vehicle controller 107 may include any suitable electronics (e.g., a microprocessor), software and/or firmware configured to provide the functionality described herein. While the controller 107 is illustrated herein schematically as a single module, the vehicle controller 107 may be functionally and physically distributed over multiple devices or subsystems.

The payload 105 may be provided as a module and may include components for vehicle guiding/navigating, sensing, communicating, operating, causing, neutralizing, marking, material-providing, and/or mass-altering, for example. In some cases, the payload 105 includes a deployable device, such as an acoustic communication node or a sonar or other sensor array. In some cases, the deployable device includes a receiver that can receive energy and/or data conducted from the vehicle 100. In some cases, the payload includes a payload battery and a payload memory for storing products of receiving, and a receiver connector, which can be of any type that can receive a submersible connector.

The payload 105 may include a communication system or module (which may be part of or connected to the vehicle controller 107, for example), which may include a radio, acoustic modem and/or light emitting device, for example. In some cases, the communication system or module includes a deployable portion such as a releasable buoyant radio or antenna.

The payload 105 may include a sensing device or module operative to sense one or more desired parameters, conditions and/or events. For example, the sensing system or module may detect an environmental parameter such as an attribute of the water (e.g., conductivity, temperature, depth, water current, turbulence, luminescence, turbidity, presence or concentration of dissolved oxygen, pH, or chlorophyll presence or concentration), or acoustic noise.

The payload 105 may include a guidance module or system. The guidance system may include a guidance system as disclosed in Applicant's U.S. Published Patent Application No. US-2008-0239874-A1, published on Oct. 2, 2008, titled "Underwater Guidance Systems, Unmanned Underwater Vehicles and Methods," the disclosure of which is incorporated herein by reference.

Figure 4:
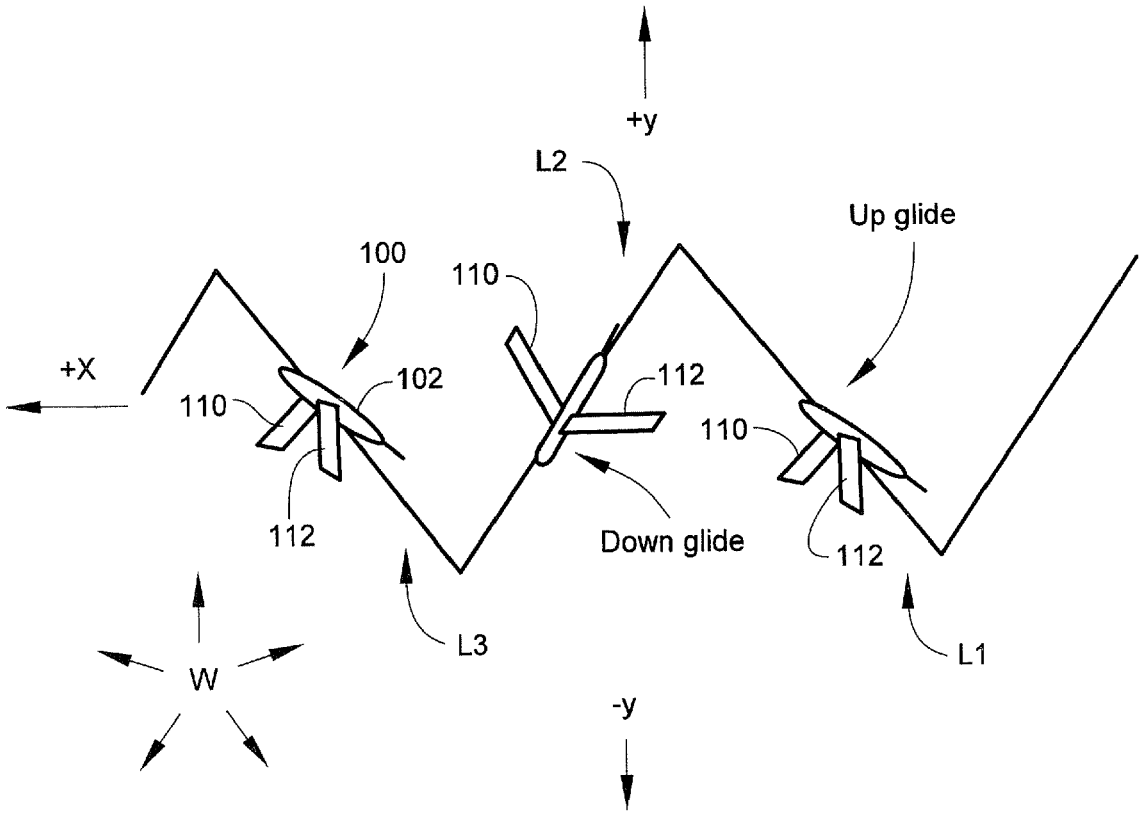
FIG. 4 is a schematic diagram illustrating a travel path of the submersible vehicle of FIG. 1.

The thrust system 103 (FIG. 1) includes a hull 102A (forming a part of the body 102), the fins 110, 112, and a buoyancy control system 104 that cooperate to generate forward thrust (e.g., in a forward direction +X as indicated in FIG. 4). In general, the buoyancy control system 104 is operable to selectively change the buoyancy of the vehicle body 102 and thereby generate a vertical force that the shape of the hull 102A and/or the fins 110, 112 convert at least partly into displacement in the forward direction. The hull 102A and/or the fins 110, 112 operate as force redirectors and are configured such that they generate a forward glide thrust responsive to changes in the elevation of the hull 110. In other embodiments, the hull 102A or the fins 110, 112 do not serve as force redirectors. According to some embodiments, the hull 102A and/or the fins 110, 112 are configured to generate a forward glide thrust both as the vehicle 100 rises and as the vehicle 100 drops due to variations in the buoyancy of the body 102. Aspects of the hull 102A and the buoyancy control system 104 will now be described. However, other hull configurations and buoyancy control mechanisms than those described and shown may be employed in some embodiments of the present invention.

The hull 102A may be sized and shaped to provide a desired lift and/or drag (which may be expressed as a lift/drag ratio (LDR)). In some embodiments, the hull 102A is sized and shaped to contain desired components and payload. The hull 102A is configured such that, when the hull 102A is subjected to a vertical thrust in the water W, the hull 102A will convert at least a portion of said vertical thrust into forward thrust (i.e., in the direction +X). That is, when a vertical flow of the water W is applied across the hull 102A, the hull 102A will generate a reaction force that is transverse to vertical (i.e., has a horizontal force vector).

In some embodiments, the hull 102A has a lift producing shape, with "lift" defined as a force at least partly orthogonal to the surface of the hull 102A, which force is generated by faster movement of a fluid or gas over that surface, according to what is commonly known as Bernoulli's principle. In some cases, the vehicle 100 includes one or more control surfaces such as a rudder or vertical stabilizer. In some cases, the vehicle 100 can further include a housing in which components can be mounted (e.g., a sensor, a processor, an energy storage device, communications electronics, and/or a payload or payload managing devices).

The buoyancy control system 104 includes a buoyancy engine, which may include a gas generator, a reservoir, and one or more outlets. The gas generator is operable to generate a displacement gas to displace water from the reservoir to thereby lower the density of the vehicle 100 and increase its buoyancy. In some embodiments, the gas generator includes a mixer and a supply or supplies of one or more gas generation substances that can generate a gas when mixed with one another or with water. The gas generator may additionally or instead include a converter unit that can convert a liquid or gas at least partly into a gas, such as by catalysis or by providing energy. The gas generator may additionally or instead include a container containing a compressed gas that can selectively release the gas. According to some embodiments, the buoyancy control system 104 includes a buoyancy control system as disclosed in U.S. patent application Ser. No. 12/315,760, filed Dec. 5, 2008, the disclosure of which is incorporated herein by reference.

The fins 110, 112 may be formed of any suitable material and in any suitable shape. For example, each fin 110, 112 may include a thin, flat, substantially rigid or semi-rigid plate. In some embodiments, the fins 110, 112 have a lift providing or generating shape. In some embodiments, the fins 110, 110 are cambered in section. In some cases, the fins 110, 112 are low drag.

Each fin 110, 112 has a respective fin tip 110A, 112A and a respective fin root 110B, 112B. The fin 110 is pivotably joined to the body 102 by a coupling 110C at the fin root 110B to rotate about a pivot axis P1-P1. The fin 112 is pivotably joined to the body 102 by a coupling 112C at the fin root 112B to rotate about a pivot axis P2-P2. The fin 110 has a fin axis D1-D1 extending through the fin tip 110A and the fin root 110B. The fin 112 has a fin axis D2-D2 extending through the fin tip 112A and the fin root 112B.

Figure 2:
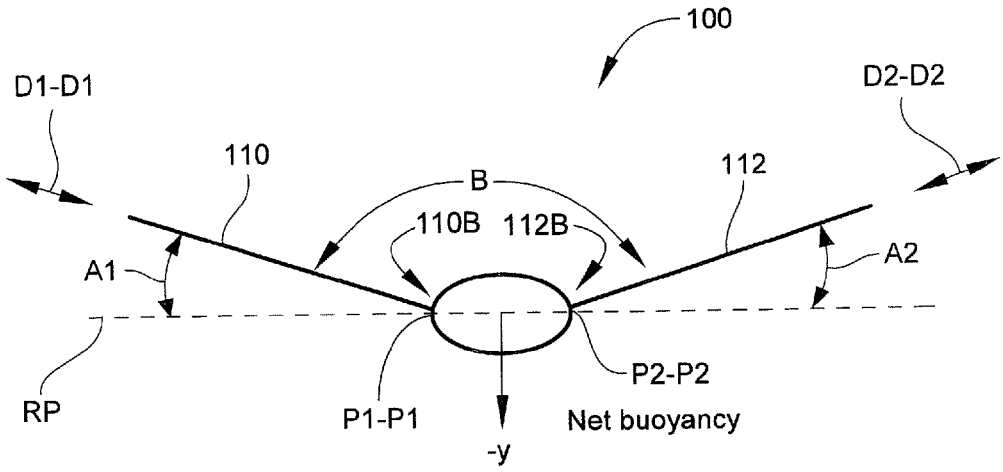
FIG. 2 is a schematic front view of the submersible vehicle of FIG. 1 wherein fins thereof are each positioned with a positive dihedral angle.
Figure 3:
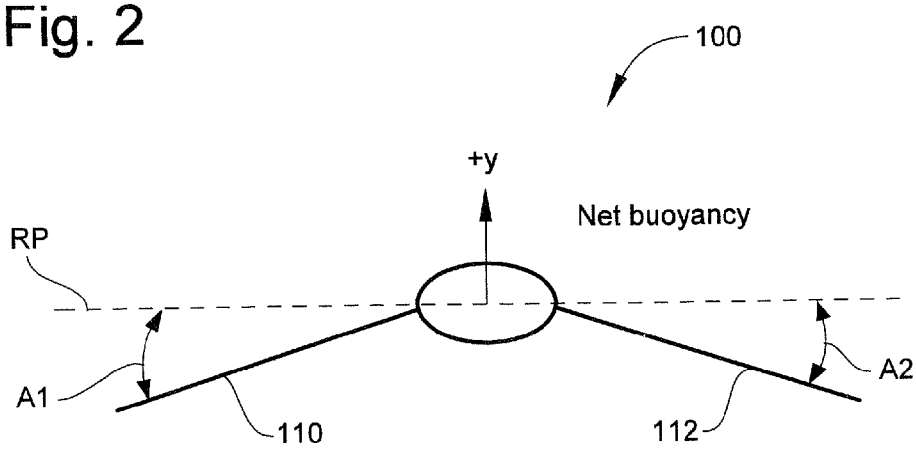
FIG. 3 is a schematic front view of the submersible vehicle of FIG. 1 wherein the fins are each positioned with a negative dihedral angle.

With reference to FIGS. 1-3, the fin 110 forms a fin dihedral angle A1 with a reference plane RP and the fin 112 forms a dihedral angle A2 with the reference plane RP. The reference plane RP extends parallel to the direction of travel T (FIG. 1) of the vehicle when the vehicle is underway. Each of the fin roots 110B, 112B is in the reference plane RP. In some embodiments and as shown in FIG. 2, the pivot axes P1-P1 and P2-P2 are parallel to the reference plane RP. In some embodiments, the center line CL-CL of the vehicle body 102 and the direction of travel T lie in the reference plane RP. According to some embodiments, when the vehicle 100 is travelling in a true horizontal direction and the vehicle buoyancy is non-zero, the reference plane RP is orthogonal to the direction of net buoyancy.

The dihedral angle control system 120 varies the dihedral angles A1, A2 of the fins 110, 112 as the vehicle transits through the water W under the force of the thrust system 103. More particularly, the orientation of each fin 110, 112 is varied through a range of fin dihedral angles A1, A2 including, on some occasions, an upward fin dihedral angle A1, A2 as show in FIG. 2 and, on some occasions, a downward fin dihedral angle A1, A2 as shown in FIG. 3. In some embodiments, the system 120 passively varies the dihedral angles A1, A2. In some embodiments, the system 120 fully or partly actively or forcibly varies the dihedral angles A1, A2.

Operations of the vehicle 100 and the dihedral angle control system 120 will now be described, followed by descriptions of more particular embodiments of the invention.

Navigation or transit of the vehicle 100 can be provided by the thrust system 103 which controllably propels the vehicle body 102. The thrust system 103 propels the vehicle 100 in the travel direction T and generally in the forward direction +X by changing the buoyancy of the vehicle 100. The buoyancy control system 104 may alter the buoyancy of the vehicle 100 by selectively generating gas to purge water from the reservoir, releasing or purging gas from the reservoir, and/or changing the capacity of the reservoir, for example. In this manner, the buoyancy control system 104 generates a vertical force (up, if the buoyancy change is positive, or down, if the buoyancy change is negative) on the vehicle 100.

As discussed above, the hull 102A may be configured to convert at least a portion of said vertical force into forward thrust (i.e., in the direction +X). In this manner, the vehicle 100 is propelled in a desired direction on a glide path with an angle determined by the LDR of the hull 102A. In embodiments wherein the hull 102A has a lift producing shape, the forward movement of the hull 102A can generate a further lift force which can alter the rate of change in depth. The buoyancy control system 104 can repeatedly adjust the vehicle buoyancy (e.g., increasing and decreasing the vehicle buoyancy) so that the vehicle 100 is continuously propelled forward by the buoyancy control system 104 while remaining generally in a desired elevation range. In some embodiments, the buoyancy control system 104 is operated to control a net buoyancy of the vehicle in response to local water density to maintain the vehicle 100 at neutral buoyancy when not being employed to change the elevation of the vehicle 100 in the water W.

Also, as discussed above, the fins 110, 112 may be configured to convert at least a portion of said vertical force into forward thrust (i.e., in the direction +X).

FIG. 4 illustrates operation of the thrust system 103 conveying the vehicle 100 through the water W and horizontally in the forward direction +X. From a position L1, the buoyancy control system 104 provides the vehicle 100 with a net positive buoyancy to create an upward force vector. The hull 102A converts a portion of the upward force vector to a horizontally directed gliding force vector so that the vehicle 100 glides or transits upwardly and forwardly to a second position L2. The buoyancy control system 104 then provides the vehicle 100 with a net negative buoyancy to create a downward force vector. The hull 102A converts a portion of the downward force vector to a horizontally directed gliding force vector so that the vehicle 100 glides downwardly and forwardly to a third position L3. The buoyancy control system 120 can again increase the vehicle buoyancy to a net positive buoyancy to glide the vehicle 100 upwardly and forwardly to a fourth position and so forth. While the vehicle 100 is illustrated as traveling in a generally sinusoidal path, other travel paths may be provided.

As discussed above, the dihedral angle control system 120 causes or enables the fins 110, 112 to rotate about their couplings 110C, 112C to vary their respective dihedral angles A1, A2. As the vehicle 100 ascends (i.e., in the vertical direction +Y) with a net positive buoyancy ("up glide"), the fins 110, 112 rotate into positions as shown in FIG. 3 and in FIG. 4 at position L1 wherein the dihedral angles A1, A2 are downward. As the vehicle 100 descends (i.e., in the vertical direction −Y) with a net negative buoyancy ("down glide"), the fins 110, 112 rotate into positions as shown in FIGS. 1 and 2 and in FIG. 4 at position L2 wherein the dihedral angles A1, A2 are upward. According to some embodiments, the dihedral angles A1, A2 may instead be substantially zero when ascending or when descending.

In this manner, the dihedral angles A1, A2 can be maintained opposite the direction of net buoyancy and the vertical component of vehicle travel. That is, the dihedral angle is downward when net buoyancy is positive and upward when the net buoyancy is negative. Dynamically varying the dihedral angles A1, A2 in this manner can provide the beneficial effects of positive, non-zero fin dihedral angle (i.e., a dihedral angle opposite the direction of net buoyancy) in one or both directions of travel (ascending and descending) without presenting the undesirable effects that would accompany having a negative dihedral angle (i.e., a dihedral angle in the same direction as net buoyancy) when descending or ascending.

Figure 5:
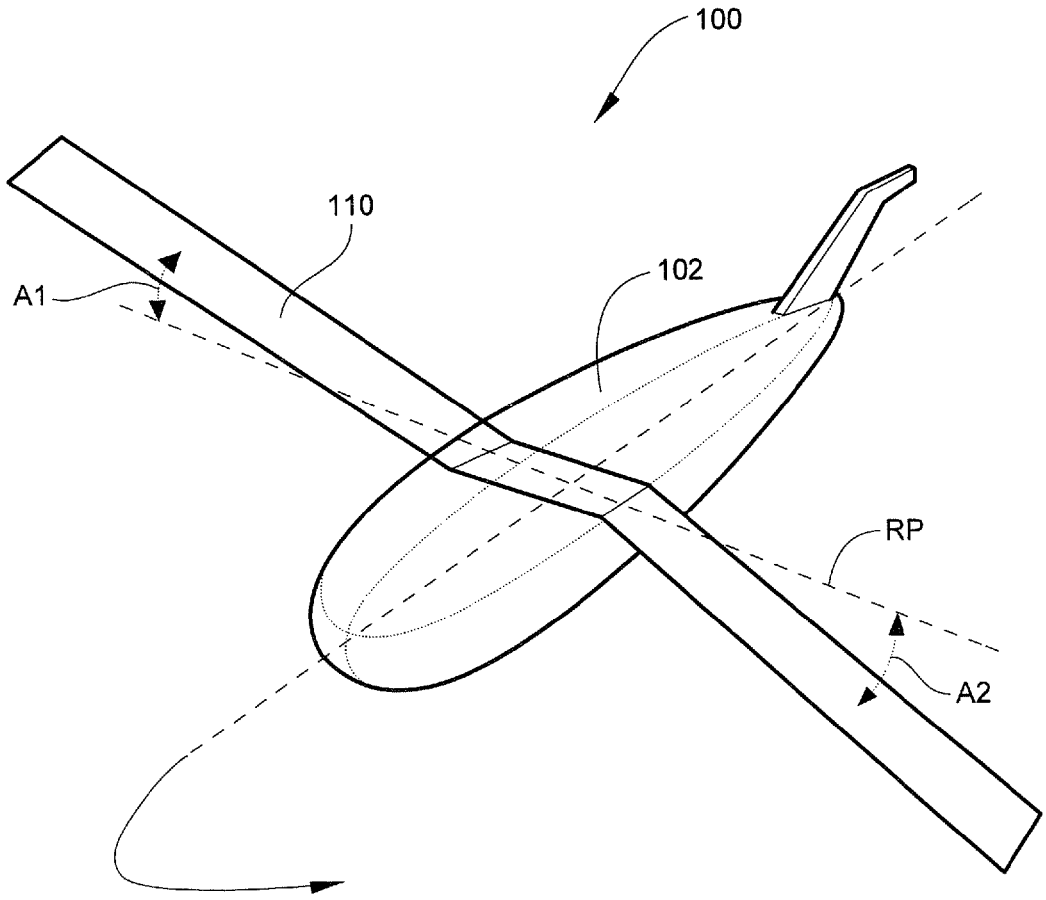
FIG. 5 is a front perspective view of the submersible vehicle of FIG. 1 executing a banking turn maneuver.

As shown in FIGS. 1-4, the dihedral angles A1, A2 of the fins 110, 112 may be maintained substantially the same to enable or facilitate travel of the vehicle 100 in a horizontally straight direction. In some cases, the dihedral angles A1, A2 may be independently controlled so that they differ from one another to induce a turning, pitching or rolling moment on the vehicle 100. For example, according to some embodiments and as illustrated in FIG. 5 (depicting the vehicle 100 with a negative buoyancy), the fin 110 can be positioned with an upward dihedral angle A1 while the fin 112 is positioned with a downward dihedral angle to direct the vehicle 100 into a banking turn.

According to some embodiments, the dihedral angle A1, A2 of each fin 110, 112 can be varied across a range of at least about 50 degrees and, according to some embodiments, a range of from at least about +25 to at least about −25 degrees. According to some embodiments, the dihedral angle A1, A2 of each fin 110, 112 can be varied across a range of at least about 90 degrees and, according to some embodiments, a range of from at least about +45 to at least about −45 degrees.

The vehicle control system 107 can include a guidance navigation and control (GNC) sensor, a state sensor, an environmental sensor, and/or a processor. In some cases, the vehicle control system 107 system can further comprise a communications system of any type such as radio, acoustic, or optical. The GNC sensor may include a depth, altitude, speed, inclination, acceleration, roll, direction, location, inertial measurement, homing, and/or obstacle avoidance sensor. The state sensor may include a buffeting, stall, vibration, pressure, leak, power, and/or system health sensor. The environmental sensor can be a temperature, conductivity, pressure, depth, acoustic, electric, electromagnetic, optical, bioluminescence and/or fluorescence sensor, for example. The processor can be any type that can process sensor signals and provide control signals to the dihedral angle control system 120, the buoyancy control system 104, the communications system, and/or a battery system.

The dihedral angle control system 120 can be used to change the dihedral angles A1, A2 (together or independently), stabilize the dihedral angles A1, A2, maneuver the vehicle 100, and/or modify the performance characteristics of the vehicle 100. Maneuvering can include transiting, turning, rising falling, rolling pitching, yawing, angle of attack changing, inclination changing, direction controlling, buffeting responding, and/or stabilizing. In some cases, maneuvering can be responsive to speed, depth, direction, and/or changes therein.

In some cases, dihedral angle change is provided passively by lift force during gliding, which pursuant to change in buoyancy can move the fin up or down. The dihedral angle control system 120 may be configured to limit the maximum obtainable upward or downward dihedral angles A1, A2 (e.g., using stops as discussed herein).

The dihedral angle control system 120 can operate passively (e.g., relying on lift force alone to change the dihedral angles A1, A2) or actively (i.e., using one or more force actuators to force a change in the dihedral angles A1, A2). Where active control is employed, the dihedral angle control system 120 may control the dihedral angles A1, A2 as a function of one or more selected parameters intrinsic or extrinsic to the vehicle 100.

The dihedral angle control system 120 may be used to provide a force responsive to buoyancy force or to intermittent forces such as buffeting. The dihedral angle control system 120 may control the dihedral angles A1, A2 responsive to navigation sensor signals, state sensor signals, and/or an intended navigational course. In some cases, the dihedral angle control system 120 processes signals representative of at least one of force on the vehicle, moment on the vehicle, vehicle speed, vehicle direction, vehicle inclination, vehicle rotation, vehicle depth, water temperature, water salinity, vehicle location, and predetermined operational parameters, and responsively provides control signals to one or more force actuators that in turn correspondingly adjust the dihedral angles A1 and/or A2. In some cases, the dihedral angle control system 120 provides a first control signal to a first force actuator operative to change the dihedral angle A1 and a second control signal to a second force actuator operative to change the dihedral angle A2 for purposes of steering, glide changing, depth changing, and/or stabilizing the vehicle 100. In some cases, the dihedral angle control system 120 provides a signal to at least one dihedral actuator as means of augmenting rate and/or magnitude of change in dihedral angle (e.g., responsive to change in net buoyancy). In some cases, this is used to speed transition between up glide and down glide.

Systems, components, mechanisms and configurations for enabling and effecting the foregoing operations and methods are described hereinafter with reference to FIGS. 6-12. However, the embodiments described are not exhaustive of vehicles according to embodiments of the present invention or suitable apparatus for enabling operations and methods according to embodiments of the present invention.

Figure 6:
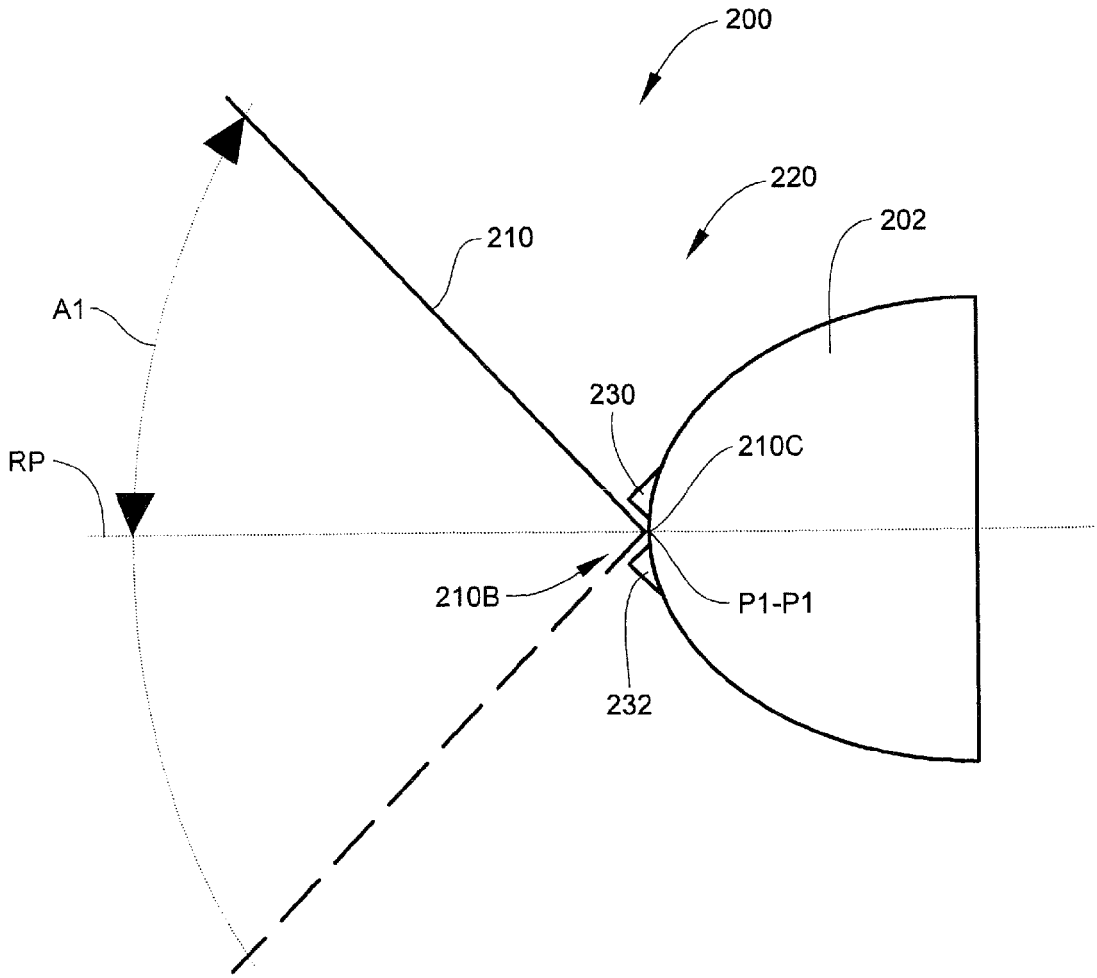
FIG. 6 is an enlarged, fragmentary, front view of a submersible vehicle according to further embodiments of the present invention.

With reference to FIG. 6, a right-side portion of a vehicle 200 according to embodiments of the present invention is shown therein, viewed from the front of the vehicle 200. The vehicle 200 corresponds to the vehicle 100 and has a fin 210 corresponding to the wing 110 and a dihedral angle control system 220 corresponding to the dihedral angle control system 120. The fin 210 is joined to the body 202 by a coupling 210C at its fin root 210B to permit the fin 210 to pivot as described above to vary the dihedral angle A1. In some embodiments, the coupling 210C is a hinge. However, any suitable coupling that can permit dihedral angle change, such as by rotation, deformation and/or translation, may be used.

The dihedral angle control system 220 includes an upper stop 230 and a lower stop 232. The fin 210 may be free to rotate about the coupling 210C within the limits imposed by the stops 230, 232. The fin 210 is thereby enabled to change the dihedral angle A1 as discussed above to beneficially match the vertical direction of glide. The change in dihedral angle may be induced by lift force or any other force acting on the fin 210. In FIG. 6, the maximum upward dihedral angle position for the fin 210 is shown in solid line and the maximum downward dihedral angle position for the fin 210 is shown in dashed line. The positions of the stops 230, 232 may be selected as a function of lift-drag ratio, lift force, drag force, center of gravity, center of lift, center of buoyancy, hull shape, trim, and/or balance. In some embodiments, the stops 230, 232 are situated asymmetrically with respect to the centerline CL-CL and/or with respect to the reference plane RP. The vehicle 200 also has a fin corresponding to the fin 112 and the dihedral angle control system 220 includes stops and a coupling (not shown) corresponding to the stops 230, 232 and coupling 210C on the opposite side of the body 202 to permit and regulate variation of the dihedral angle A2. The dihedral angle control system 220 may be regarded as a passive system (i.e., no actuator is employed to directly vary the dihedral angles of the fins).

According to some embodiments, one or more of the stops 230, 232 may be position adjustable in order to change the endpoints and/or ranges of permitted dihedral angles. The stops 230, 232 may be manually adjustable and/or adjustable via one or more actuators (e.g., connected to the vehicle controller 107 or another suitable controller).

Figure 7:
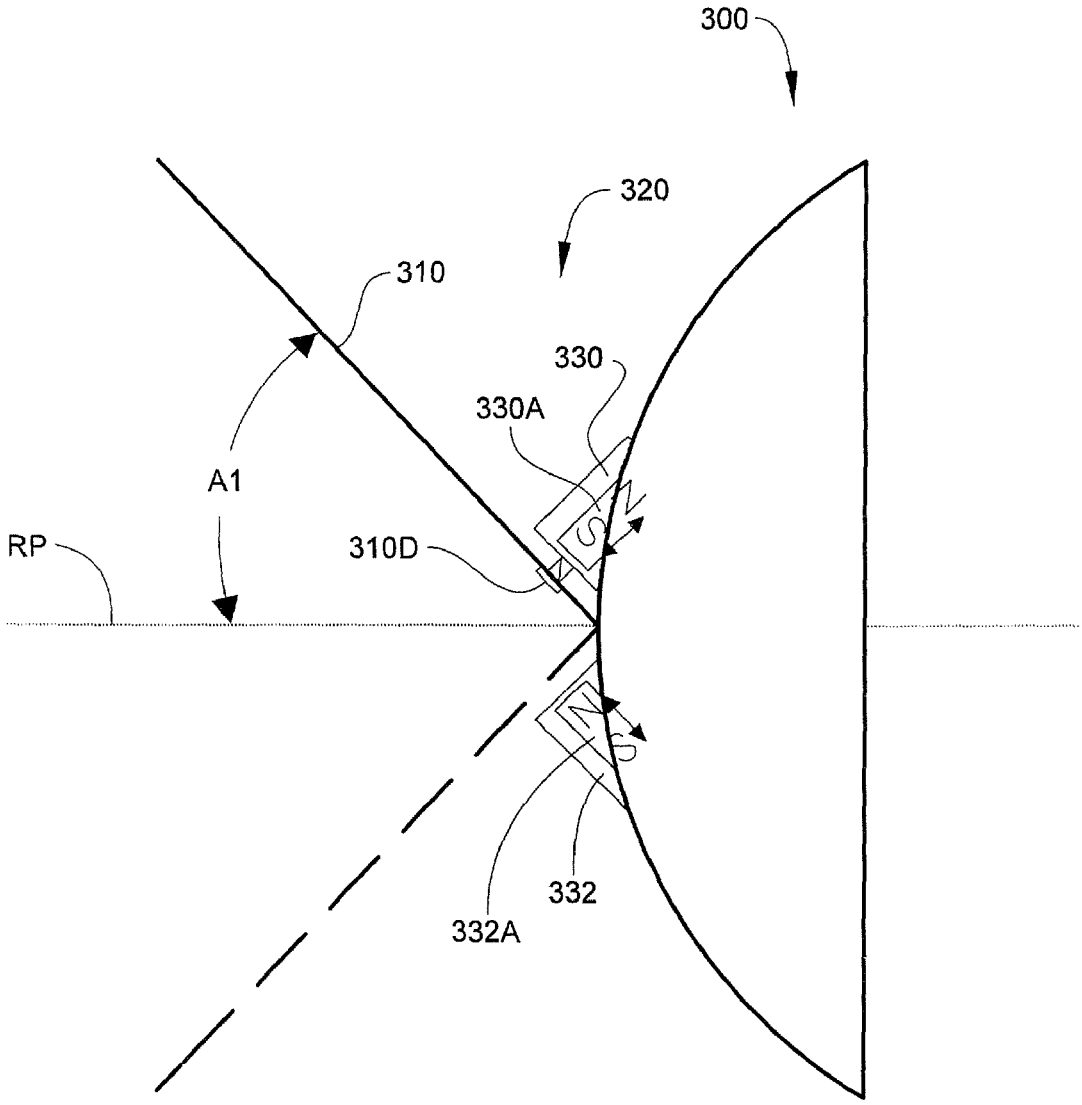
FIG. 7 is an enlarged, fragmentary, front view of a submersible vehicle according to further embodiments of the present invention.

With reference to FIG. 7, a right-side portion of a vehicle 300 according to embodiments of the present invention is shown therein, viewed from the front of the vehicle 300. The vehicle 300 corresponds to the vehicle 200 and has a fin 310 corresponding to the fin 210 and a dihedral angle control system 320 corresponding to the dihedral angle control system 220 except as follows. The dihedral angle control system 320 further includes respective magnets 330A, 332A mounted on (e.g., embedded in) each stop 330, 332 and a magnetically attractable portion 310D of the fin 310, which collectively form a passive magnetic actuator. The magnets 330A, 332A and the magnetically attractable portion 310D may be permanent magnets, for example. The magnet 330A is oriented to attract the upper portion of the portion 310D and the magnet 332A is oriented to attract the lower portion of the portion 310D. In use, the magnets 330A, 332A and portion 310D serve to releasably urge the fin 310 toward the nearer of the stops 330, 332 to stabilize the fin 310 and/or to accelerate the transition to a new dihedral angle. The stabilizing force may serve to resist buffeting, for example. The vehicle 300 also has a fin corresponding to the fin 112 and the dihedral angle control system 320 includes components (not shown) corresponding to the components 330, 332, 330A, 332A, 310D on the opposite side of the body 302 to permit and regulate variation of the dihedral angle A2.

The strengths of the magnets 330A, 332A (and 310A, if a magnet) may be selected to accommodate the anticipated fin lift force and other parameters. For example, the attraction may be strong enough to stabilize the fin 310 during up and down glide but not so strong as to prevent dihedral angle change pursuant to a change in the direction of net buoyancy.

In some cases, the dihedral angle control system 320 further includes a reversible interlock that can mechanically engage the fin 310 to hold the fin 310 proximate the stops 330A, 332A.

Figure 8:
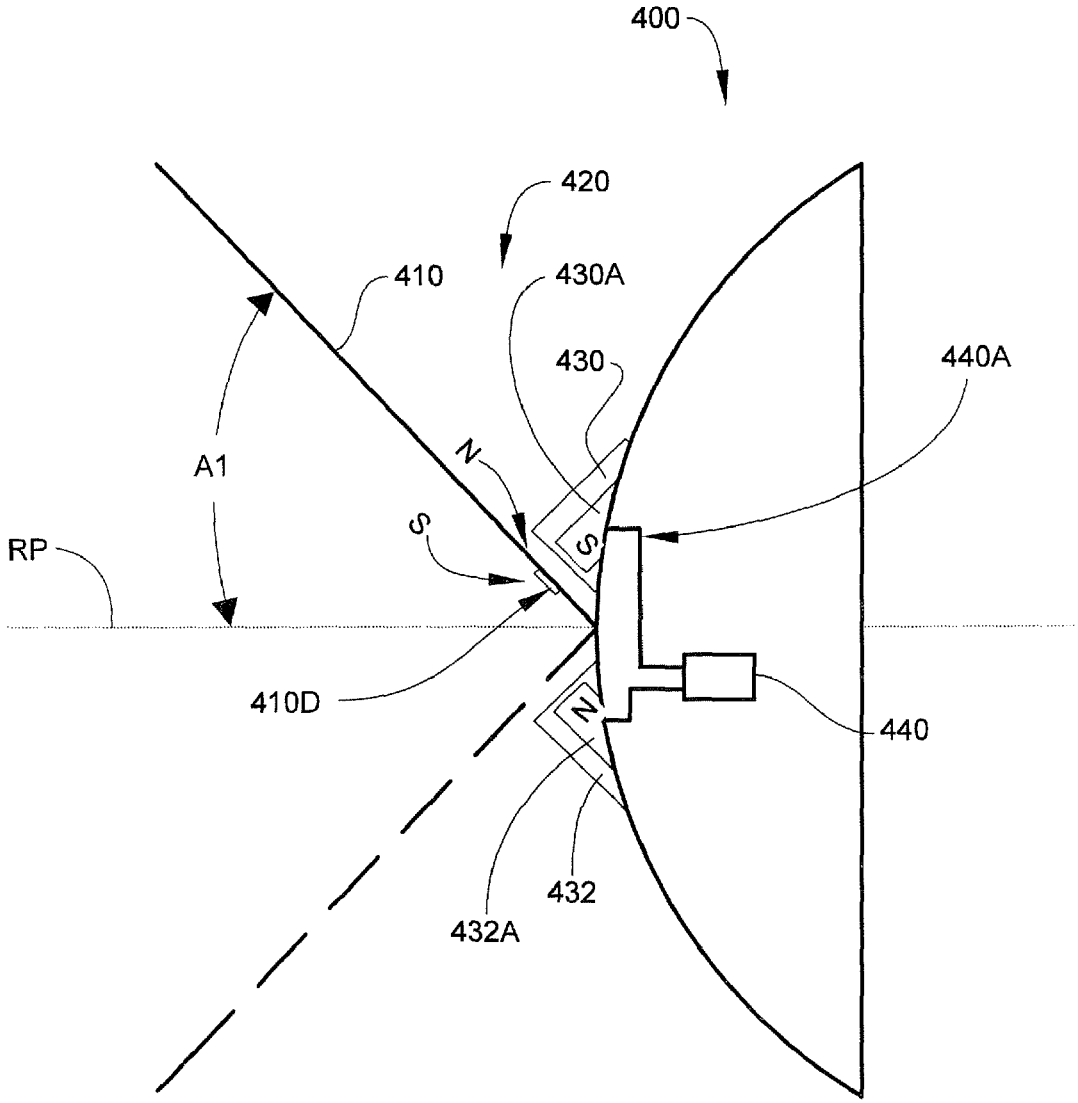
FIG. 8 is an enlarged, fragmentary, front view of a submersible vehicle according to further embodiments of the present invention.

With reference to FIG. 8, a right-side portion of a vehicle 400 according to embodiments of the present invention is shown therein, viewed from the front of the vehicle 400. The vehicle 400 corresponds to the vehicle 300 and has a fin 410 corresponding to the fin 310 and a dihedral angle control system 420 corresponding to the dihedral angle control system 320 except as follows. The magnets 430A, 432A of the dihedral angle control system 420 mounted in the stops 430, 432 are electromagnets. The dihedral angle control system 420 further includes a magnet controller 440 electrically coupled to the magnets 430A, 432A by connections 440A. The magnet controller 440 may selectively activate or deactivate each of the electromagnets 430A, 432A to magnetically pull the attractable fin portion 410D toward a selected one of the stops 430, 432 and/or to magnetically push the attractable fin portion 410D away from a selected one of the stops 430, 432. The vehicle 400 likewise has a fin (now shown) corresponding to the fin 112 opposite the fin 410 and regulated by electromagnets as described for the fin 410.

Figure 9:
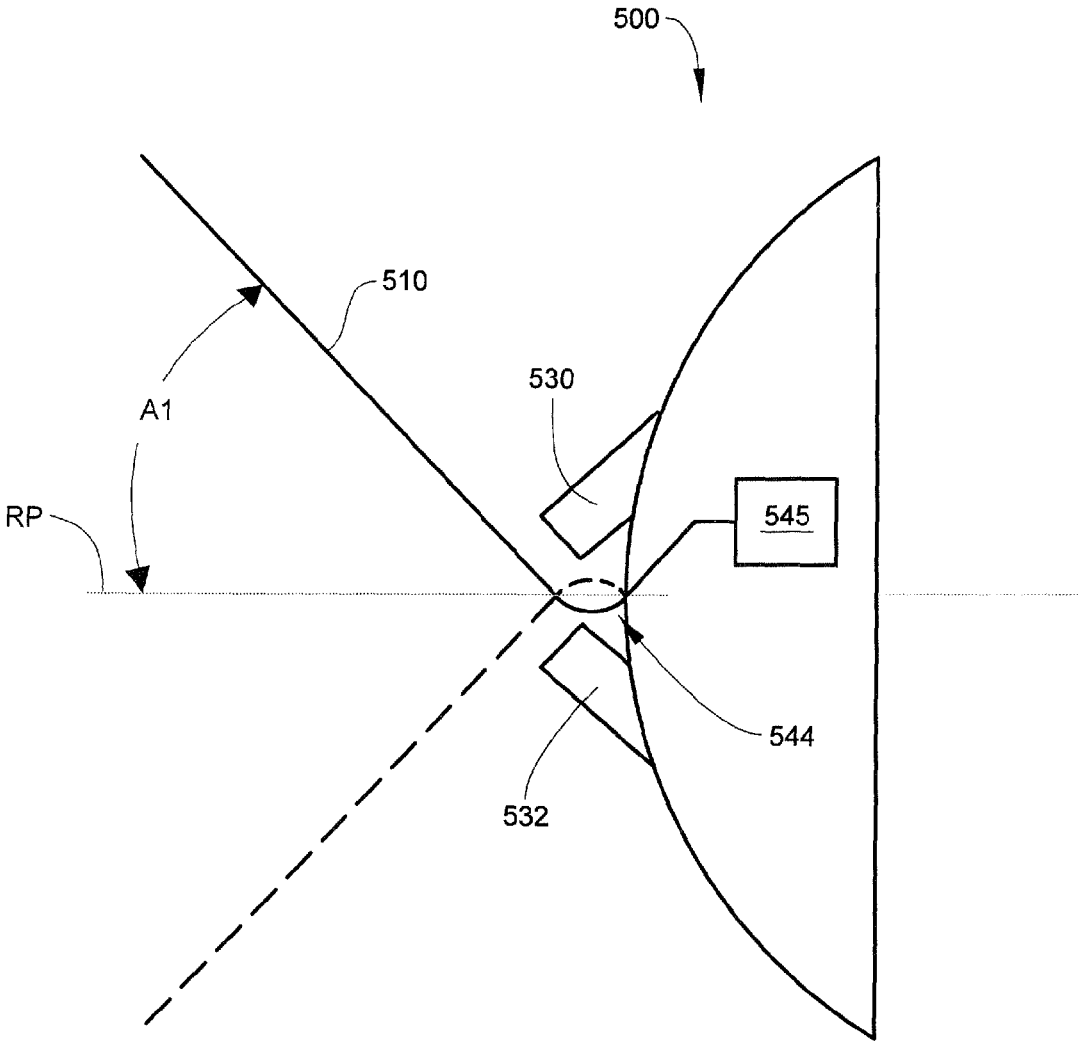
FIG. 9 is an enlarged, fragmentary, front view of a submersible vehicle according to further embodiments of the present invention.

With reference to FIG. 9, a right-side portion of a vehicle 500 according to embodiments of the present invention is shown therein, viewed from the front of the vehicle 500. The vehicle 500 corresponds to the vehicle 200 and has a fin 510 corresponding to the fin 210 and a dihedral angle control system 520 corresponding to the dihedral angle control system 220 except as follows. The dihedral angle control system 320 further includes an elastically deformable biasing member 544 having a plurality of alternative stable configurations. The biasing member 544 urges the fin 510 toward one of two different fin positions depending on the position of the fin 510 and/or other conditions.

In some embodiments, the biasing member 544 is a spring. In some embodiments, the biasing member 544 has a maximum force at zero dihedral angle and a minimum force at prescribed positive and/or negative dihedral angles other than zero. According to some embodiments, the maximum force of the biasing member 544 is less than a prescribed lift force in order to enable the fin 510 to transition between upward and downward dihedral angles responsive to change in the direction of lift force.

In some embodiments, the biasing member 544 is a bistable spring configured such that the biasing member 544 forces the fin 510 toward the upper stop 530 when the dihedral angle A1 is greater than a prescribed upward dihedral angle and forces the fin 510 toward the lower stop 532 when the dihedral angle A1 is greater than a prescribed downward dihedral angle.

In some embodiments, the biasing member 544 is a deformable member including a memory metal. An electrical power controller 545 selectively applies electrical current to the memory metal to induce the biasing member 544 to alternately assume each of its stable configurations depending on the position of the fin 510 and/or other conditions. The electrical power controller 545 may be networked with the vehicle controller 107 so that the vehicle controller 107 can control the biasing member 544 according to other factors generated or sensed by the vehicle controller 107.

The vehicle 500 also has a fin corresponding to the fin 112 and the dihedral angle control system 520 includes a biasing member (not shown) corresponding to the biasing member 544 on the opposite side of the body 502 to permit and regulate variation of the dihedral angle A2.

Figure 10:
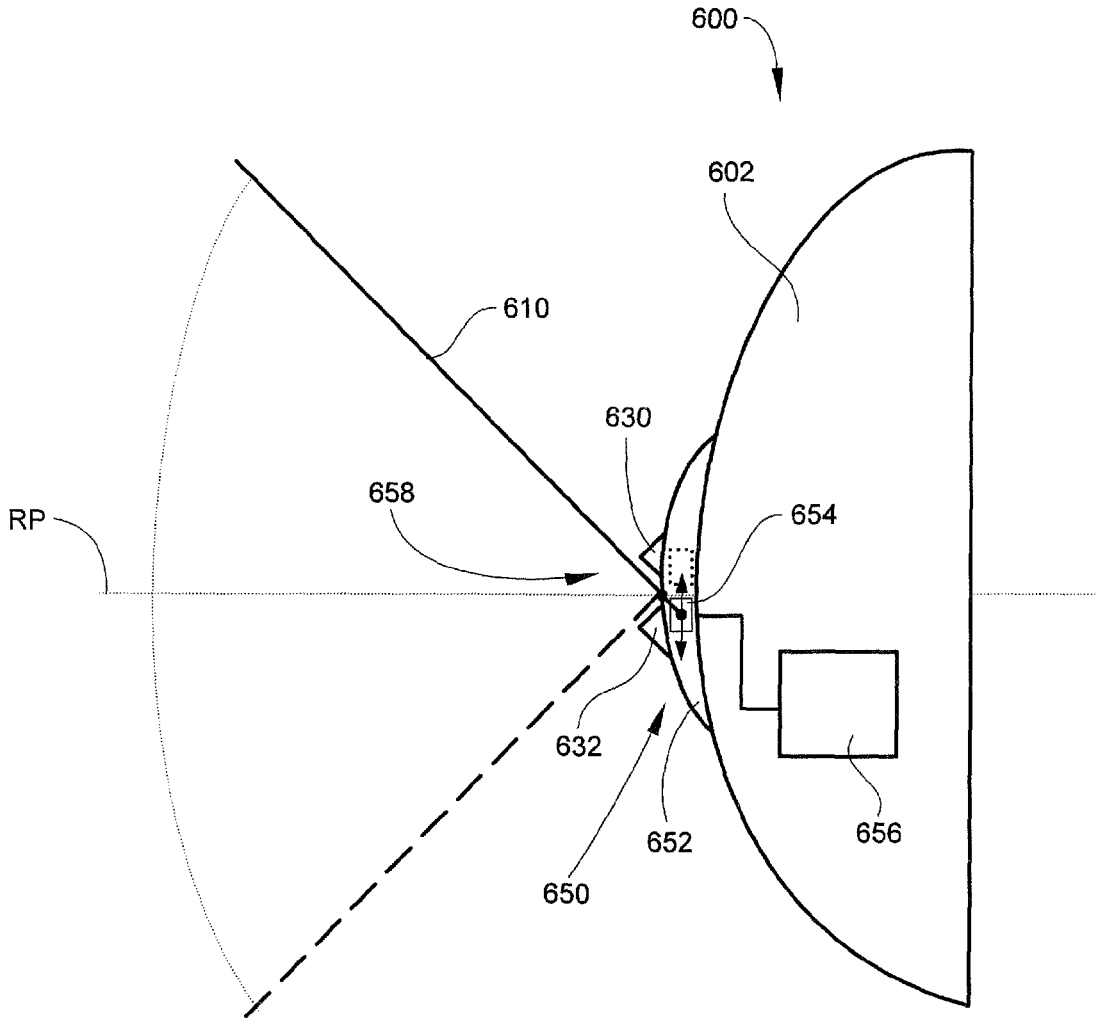
FIG. 10 is an enlarged, fragmentary, front view of a submersible vehicle according to further embodiments of the present invention.

With reference to FIG. 10, a right-side portion of a vehicle 600 according to embodiments of the present invention is shown therein, viewed from the front of the vehicle 600. The vehicle 600 corresponds to the vehicle 200 and has a fin 610 corresponding to the fin 210 and a dihedral angle control system 620 corresponding to the dihedral angle control system 220 except as follows. The dihedral angle control system 620 includes upper and lower stops 630, 632 and a force actuator system 650. The force actuator system 650 includes a force actuator 654, an actuator controller 656, and a couple 658 operatively connecting the actuator 654 to the fin 610. A mount 652, such as a low drag shell, may house and secure some or all of the force actuator system 650 to the body 602. In use, the actuator controller 656 actuates the actuator 654 to force the fin 610 to pivot in either direction to actively change the dihedral angle A1 of the fin 610. The actuator controller 656 may be networked with the vehicle controller 107 so that the vehicle controller 107 can control the biasing member 544 according to other factors generated or sensed by the vehicle controller 107. According to some embodiments, the force actuators associated with the left and right side fins are independently controllable to actively position the fins at different dihedral angles A1, A2 from one another as disclosed above with regard to FIG. 5.

Suitable types of active actuators for the actuator 654 may include a linear motor (as illustrated; e.g., as sold by Balder Electric Company of Fort Smith, Ark.), a stepper motor (e.g., as sold by Shinano Kenshi Corp. of Culver City, Calif.), a solenoid (e.g., as sold by Magnetic Sensor Systems of Van Nuys, Calif.), a Lorenz force motor, or a flooded actuator as disclosed in co-pending U.S. patent application Ser. No. 12/348,956, the disclosure of which is incorporated herein by reference. According to some embodiments, the actuator 654 is operable to provide a continuously variable dihedral angle A1. According to some embodiments, the force actuator is a rotational actuator or stepper motor comprising a portion of the fin root.

Figure 11:
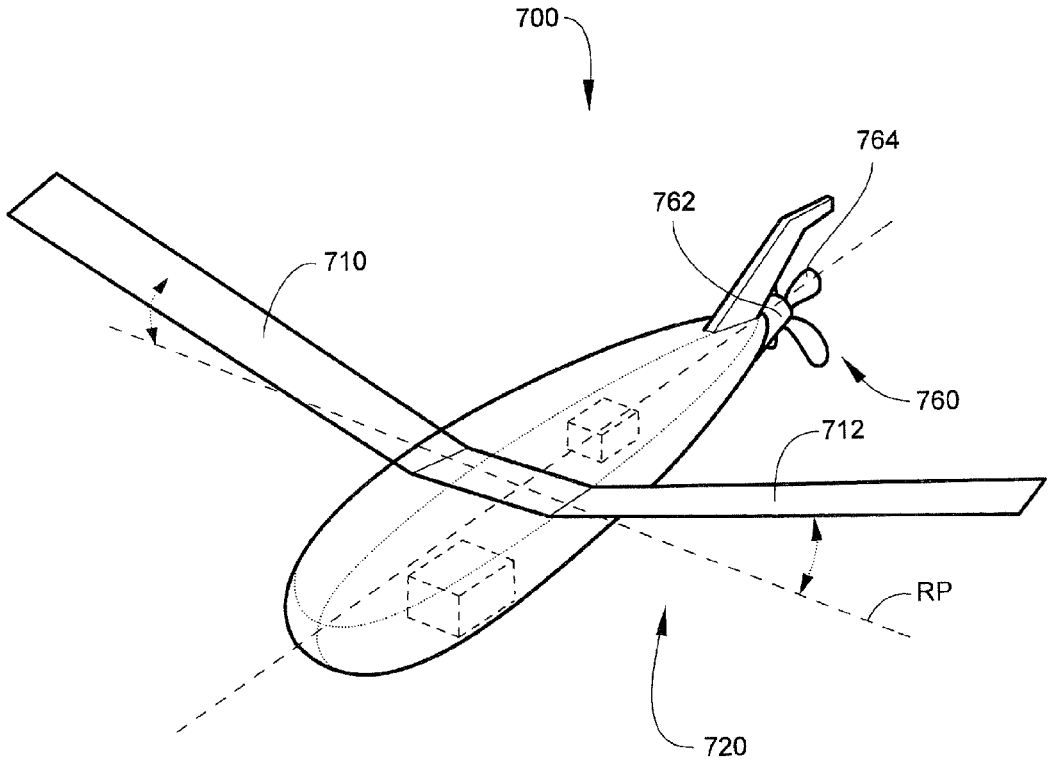
FIG. 11 is a front perspective view of a submersible vehicle according to further embodiments of the present invention.

With reference to FIG. 11, a vehicle 700 according to further embodiments of the present invention is shown therein. The vehicle 700 includes opposed fins 710, 712 and corresponds to the vehicle 100 except that the vehicle further includes an active propulsion system 760 in addition to or in place of the buoyancy control system 104. The active propulsion system 760 includes a propeller 764 and a motor 762. The active propulsion system 760 may be used to drive the vehicle 700 forward and, in some cases, to steer the vehicle 700. The vehicle 700 may incorporate any of the features or aspects discussed herein with regard to the vehicles 100, 200, 300, 400, 500, 600. For example, the dihedral angle control system 720 of the vehicle 700 may be configured as discussed herein with respect to any of the dihedral angle control systems 120, 220, 320, 420, 520, 620.

Figure 12:
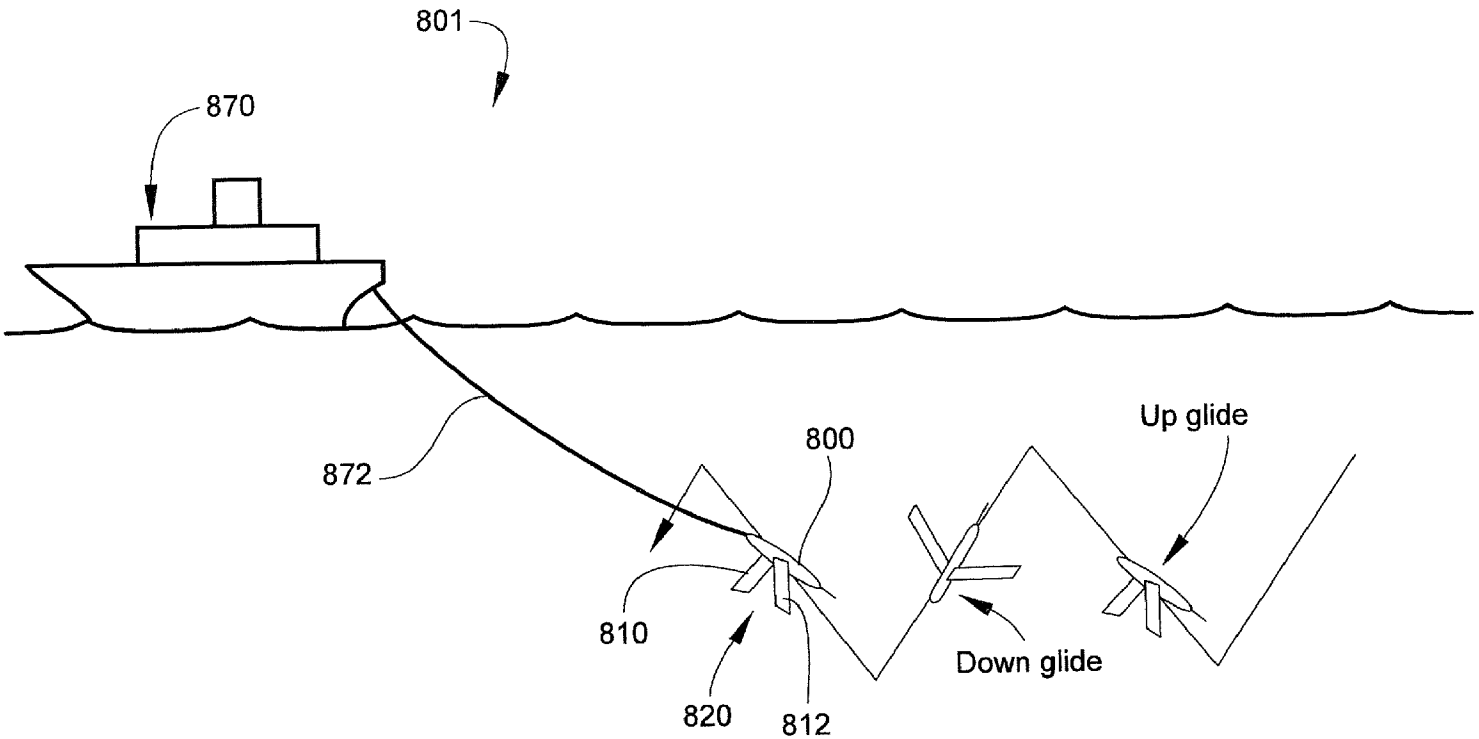
FIG. 12 is a schematic view of a glider tow system according to further embodiments of the present invention.

With reference to FIG. 12, a glider system 801 according to further embodiments of the present invention is shown therein. The glider system 801 includes a submersible vehicle 800 and a tow vehicle 870. The vehicle 800 includes opposed fins 810, 812 and a dihedral angle control system 820. The vehicle 800 is joined to and towed by the tow vehicle 870 via a tether 872. The vehicle 800 may incorporate any of the features or aspects discussed herein with regard to the vehicles 100, 200, 300, 400, 500, 600. For example, the dihedral angle control system 820 of the vehicle 800 may be configured as discussed herein with respect to any of the dihedral angle control systems 120, 220, 320, 420, 520, 620.

According to some methods, the dihedral angle of one of the opposed fins is held steady (e.g., using an active control mechanism as described with reference to FIG. 8 or FIG. 10) while the dihedral angle of the other fin is permitted or caused to transition or switch as the vertical component of vehicle travel flips (i.e., the vehicle changes from ascending to descending or vice-versa). This method may cause the vehicle to execute an enhanced turn at the very beginning of an up or down glide of the vehicle.

Submersible vehicles (e.g., aquatic gliders), dihedral angle control systems and methods as disclosed herein can provide enhanced operational capabilities. Gliders and actuators are provided that permit and/or provide change in fin dihedral angle between the tip glide and down glide portions of a glide cycle to provide a fin dihedral angle that is positive during both the down and up glide portions. The dihedral angle control system can thereby provide enhanced performance in terms of maneuverability, stability, and/or energy efficiency. The dihedral angle control system may also provide differential control of actuators on contra-lateral fins to provide enhanced maneuverability of the vehicle.

The vehicle 100 can be used to carry a payload to a desired location. The vehicle 100 can carry one or more sensors for operations. An illustrative payload includes one or more sensors or a sensing array. In some cases, the sensor and/or array is deployable. A second illustrative payload includes a neutralization charge. A third illustrative payload is materiel for personnel. A fourth illustrative payload is a releasable device for communicating from proximate the water surface. A fifth illustrative includes a marker that can provide a signal, such as for navigation aiding and/or communicating.

The vehicle 100 can be navigated to establish an operating position, and may be further navigated to establish a second, subsequent operating position. In some cases, the operating position is established by settling on or, at least partly, in sediment.

The vehicle 100 may be used to conduct surveillance and/or survey in the operational area. In some cases, the vehicle 100 detects signals and/or images, water parameters, and/or events. In some cases, the vehicle 100 communicates responsive to detecting. In some cases, the vehicle 100 deposits and/or releases a payload. In some cases, the vehicle 100 operates or monitors a deposited or deployed payload. In some cases, the vehicle 100 recovers an object. In some cases, the vehicle 100 interchanges energy and/or data with a secondary object. One example is providing energy and/or data to a secondary object. In another example, the vehicle 100 retrieves data from a secondary object. In some embodiments, the secondary object includes a sensing system deployed in the substratum. In some embodiments, the secondary object includes another vehicle.

The sensor device may be used to determine a location of the vehicle 100 such as by GPS or compass reading. In some cases, the sensor device detects signals and/or water parameters. In some cases, signal detection by the sensor device includes processing signals and/or parameters according to an algorithm. In some cases, the sensor device senses signals (e.g., acoustic, optical, electrical, or magnetic) indicative of a desirably sensed construction. In some cases, the sensor device determines an environmental potential (e.g., redox potential) of sediment. In some cases, the sensor device infers a location of the vehicle (e.g., from signals of opportunity). The results of detecting may be processed to classify a signal and/or its source or to provide a derived parameter such as a sound velocity, a water current profile and or a water salinity profile, for example.

In some embodiments, at least a portion of a communications device is deployed to communicate. The communications module may send data reflective of location and/or results of processing. In some cases, the vehicle releases an expendable communication devices such as disclosed in co-assigned U.S. patent application Ser. Nos. 11/494,941 and 11/495,134, the disclosures of which are incorporated herein by reference. In some cases, the communications device uses a radio and/or an optical or acoustic transponder. In some cases, the communications device receives signals such as commands, algorithm updates, or operational data.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed:

1. A submersible vehicle for use in a body of liquid, the submersible vehicle being an underwater glider, and comprising:

a vehicle body;

a pair of fins coupled to the vehicle body on opposed sides thereof;

a dihedral angle control system operative to vary a fin dihedral angle of each of the fins; and a buoyancy control system operable to selectively generate vertical force on the submersible vehicle by varying a buoyancy of the submersible vehicle;

wherein the shape of at least one of the vehicle body and the pair of fins is configured to convert at least part of the vertical force into a forward glide thrust on the submersible vehicle.

2. The submersible vehicle of claim 1 wherein the fin dihedral angle of each of the fins is upward when the submersible vehicle is descending and downward when the submersible vehicle is ascending.

3. The submersible vehicle of claim 1 wherein the submersible vehicle includes an active thrust system operative to propel the submersible vehicle through the body of liquid.

4. The submersible vehicle of claim 1 wherein each fin is joined to the body at a respective fin root and pivots about a pivot axis at the fin root to vary the fin dihedral angle of the fin.

5. The submersible vehicle of claim 4 including a pair of opposed stops associated with each fin and configured to limit the range of fin dihedral angles assumable by the fin.

6. The submersible vehicle of claim 1 wherein the dihedral angle control system is operative to passively vary the fin dihedral angle of each of the fins.

7. The submersible vehicle of claim 1 wherein the dihedral angle control system includes a biasing member to change and/or maintain a dihedral angle of at least one of the fins.

8. The submersible vehicle of claim 1 wherein the dihedral angle control system includes at least one magnet or magnetic actuator to induce each of the fins into at least one selected fin dihedral angle.

9. The submersible vehicle of claim 1 wherein the dihedral angle control system is operative to actively vary the fin dihedral angle of each of the fins.

10. The submersible vehicle of claim 9 wherein the dihedral angle control system includes:

at least one magnetic actuator to induce each of the fins into at least one selected fin dihedral angle; and a magnet force controller to control an attraction force of the at least one magnetic actuator.

11. The submersible vehicle of claim 9 wherein the dihedral angle control system includes:

at least one force actuator operable to forcibly vary the fin dihedral angles of the fins; and a force actuator controller to control actuation of the force actuator.

12. The submersible vehicle of claim 1 wherein the fins pivot independently of one another to position the fins at different respective fin dihedral angles from one another.

13. A method of providing transit of a submersible vehicle through a body of liquid, the submersible vehicle being an underwater glider and including a vehicle body, a pair of fins coupled to the vehicle body on opposed sides thereof, and a buoyancy control system, the method comprising:

varying a fin dihedral angle of each of the fins using a dihedral angle control system; and using the buoyancy control system, selectively generating vertical force on the submersible vehicle by varying a buoyancy of the submersible vehicle;

wherein the shape of at least one of the vehicle body and the pair of fins converts at least part of the vertical force to a forward glide thrust on the submersible vehicle.

14. The method of claim 13 including:

positioning each fin to have an upward fin dihedral angle when the submersible vehicle is descending; and positioning each fin to have a downward fin dihedral angle when the submersible vehicle is ascending.

15. The method of claim 13 wherein varying the fin dihedral angle of each of the fins includes actively varying the fin dihedral angle of each of the fins using the dihedral angle control system.

16. The method of claim 15 wherein:

the dihedral angle control system includes:

at least one magnetic actuator to induce each of the fins into at least one selected fin dihedral angle; and a magnet force controller; and the method includes controlling an attraction force of the at least one magnetic actuator using the magnet force controller.

17. The method of claim 15 wherein:

the dihedral angle control system includes:

at least one force actuator operable to forcibly vary the fin dihedral angles of the fins; and a force actuator controller; and the method includes controlling actuation of the force actuator using the force actuator controller.

18. The method of claim 13 wherein varying the fin dihedral angle of each of the fins includes pivoting the fins independently of one another to position the fins at different respective fin dihedral angles from one another.

19. The method of claim 18 including raising one of the fins to an upward fin dihedral angle and lowering the other fin to a downward fin dihedral angle to cause or assist turning of the submersible vehicle.

20. The submersible vehicle of claim 1 wherein the vehicle body includes a hull, and the hull and/or the fins convert at least part of the vertical force generated by varying the buoyancy of the submersible vehicle into the forward glide thrust.

21. The submersible vehicle of claim 20 wherein a shape of the hull is configured to convert at least part of the vertical force generated by varying the buoyancy of the submersible vehicle into the forward glide thrust.

22. The submersible vehicle of claim 20 wherein the fins are configured to convert at least part of the vertical force generated by varying the buoyancy of the submersible vehicle into the forward glide thrust.

23. The method of claim 13 wherein the vehicle body includes a hull, and the hull and/or the fins convert at least part of the vertical force generated by varying the buoyancy of the submersible vehicle into the forward glide thrust.

24. The method of claim 23 wherein a shape of the hull is configured to convert at least part of the vertical force generated by varying the buoyancy of the submersible vehicle into the forward glide thrust.

25. The method of claim 23 wherein the fins are configured to convert at least part of the vertical force generated by varying the buoyancy of the submersible vehicle into the forward glide thrust.

26. A submersible vehicle for use in a body of liquid, the submersible vehicle comprising:

a vehicle body;

a pair of fins coupled to the vehicle body on opposed sides thereof; and a dihedral angle control system operative to actively vary a fin dihedral angle of each of the fins, wherein the dihedral angle control system includes:

at least one magnetic actuator to induce each of the fins into at least one selected fin dihedral angle; and a magnet force controller to control an attraction force of the at least one magnetic actuator.

27. A method of providing transit of a submersible vehicle through a body of liquid, the submersible vehicle including a vehicle body and a pair of fins coupled to the vehicle body on opposed sides thereof, the method comprising:

actively varying a fin dihedral angle of each of the fins using a dihedral angle control system;

wherein:

the dihedral angle control system includes:

at least one magnetic actuator to induce each of the fins into at least one selected fin dihedral angle; and a magnet force controller; and the method includes controlling an attraction force of the at least one magnetic actuator using the magnet force controller.

28. A submersible vehicle for use in a body of liquid, the submersible vehicle being an aquatic glider and comprising:

a vehicle body;

a pair of fins coupled to the vehicle body on opposed sides thereof;

a dihedral angle control system operative to vary a fin dihedral angle of each of the fins; and a buoyancy control system operable to selectively generate vertical force on the submersible vehicle by varying a buoyancy of the submersible vehicle;

wherein the submersible vehicle is configured to generate a forward glide thrust on the submersible vehicle responsive to changes in elevation of the submersible vehicle.

29. A method of providing transit of a submersible vehicle through a body of liquid, the submersible vehicle being an aquatic glider and including a vehicle body, a pair of fins coupled to the vehicle body on opposed sides thereof, and a buoyancy control system, the method comprising:

varying a fin dihedral angle of each of the fins using a dihedral angle control system; and using the buoyancy control system, selectively generating vertical force on the submersible vehicle by varying a buoyancy of the submersible vehicle and thereby changing the elevation of the submersible vehicle in the water, responsive to which the submersible vehicle generates a forward glide thrust on the submersible vehicle.

* * * * *